United States Patent [19]

Fraser

[11] 4,370,767

[45] Feb. 1, 1983

[54] BEACH MAT

[75] Inventor: Alberto Fraser, Guaynabo, P.R.

[73] Assignee: Commonwealth of Puerto Rico, San Juan, P.R.

[21] Appl. No.: 254,169

[22] Filed: Apr. 14, 1981

[51] Int. Cl.[3] ..... A45C 9/00

[52] U.S. Cl. ..... 5/417

[58] Field of Search ..... 5/413, 417–420, 5/465; 297/457; 108/34, 38, 67, 68; 52/121

[56] References Cited

U.S. PATENT DOCUMENTS

| | | | |
|---|---|---|---|
| 239,938 | 4/1881 | Crofford et al. | 5/417 X |
| 1,126,611 | 1/1915 | Wright | 108/67 |
| 3,380,088 | 4/1968 | D'Adesky | 5/420 |
| 3,884,159 | 5/1975 | Faria | 108/67 X |
| 4,101,994 | 7/1978 | Hoyt | 5/419 |

FOREIGN PATENT DOCUMENTS

| | | | |
|---|---|---|---|
| 195205 | 3/1965 | Sweden | 5/420 |

*Primary Examiner*—Roy D. Frazier
*Assistant Examiner*—Michael F. Trettel
*Attorney, Agent, or Firm*—Scrivener, Clarke, Scrivener and Johnson

[57] ABSTRACT

The disclosure is of a beach mat for human use comprising a center section which may be adjusted to provide a surface on which the body may rest in a reclining or sitting position and which has bottom and head end parts. The bottom end part has side panels which may be folded under the center section to permit rigid maintenance of an upward fold in part of the center section, and the head end part has side panels pivotally connected to the center section which may be folded rearwardly from the center section to support the head end part of the center section in raised position for head and back support.

6 Claims, 8 Drawing Figures

BEACH MAT

SUMMARY OF THE INVENTION

An elongated beach mat is divided into a longitudinally extending center section having a bottom end and a head end, side panels which are pivotally connected respectively to the side edges of the bottom end for folding only to the back of the bottom end of the center section, and trapezoid shaped side panels which are pivotally connected respectively to the side edges of the head end for folding only to the back of the head end of the center section. In a preferred embodiment all parts of the mat are formed of pivotally connected parallel rods which extend transversely of the mat. In all embodiments the mat may be rolled from end to end into a spiral package for carrying.

DESCRIPTION OF THE INVENTION

Figure 1:
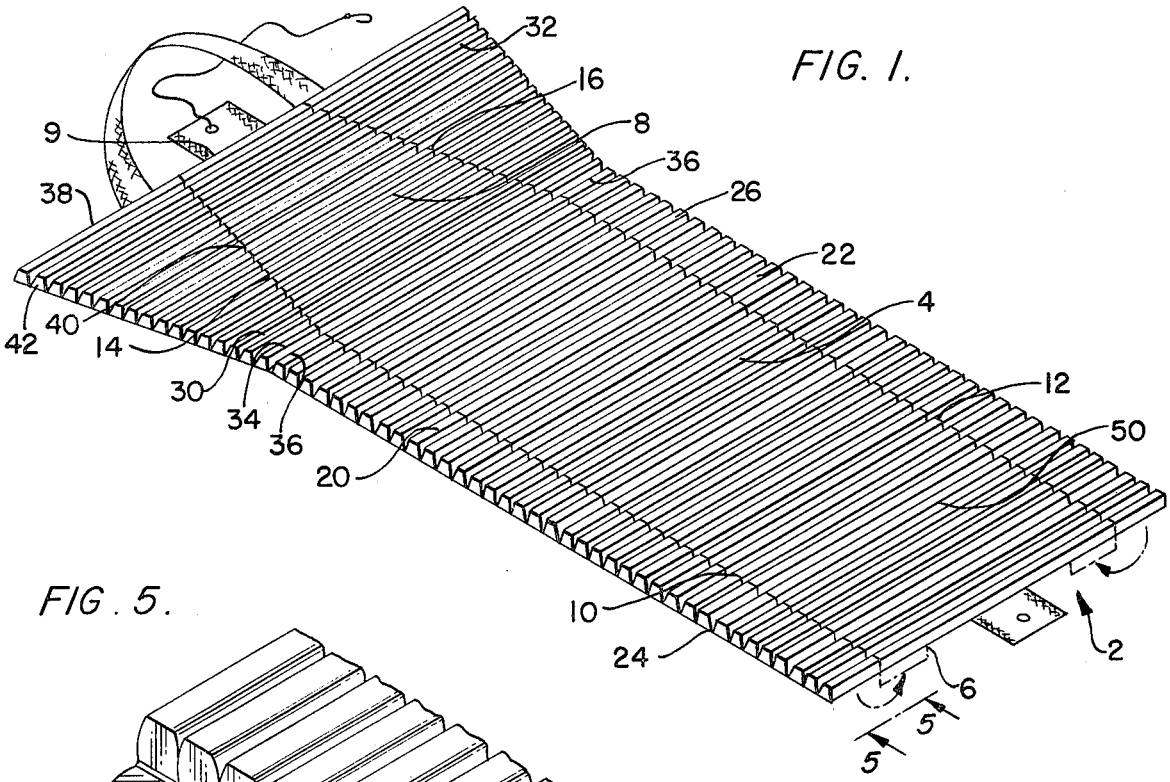
FIG. 1 is a perspective view of the mat in flat condition ready to be put into its set-up condition for use.

The invention provides a mat for beach or other use which may be rolled up for carrying and, when unrolled for use, may be used flat or set up in various configurations to provide a headrest, backrest or seat or to provide support for the legs and knees at and adjacent its bottom end.

The preferred embodiment of the mat is disclosed in the drawings and comprises an elongated central section 2 having a bottom or leg end part 4 with bottom end edge 6, and an upper or head end part 8 with end edge 9. The bottom end part 4 has parallel side edges 10, 12 which extend at right angles from bottom end edge 6 toward the upper end edge 9 to points spaced substantially from the head end edge, from which points the side edges 14, 16 of the central part converge to edge 9, leaving a space between them at that edge. The central section of the mat is of sufficient width and length to comfortably receive the body of a person of normal size.

The bottom end of the mat is completed by rectangular side edge panels 20, 22 which extend respectively along the full lengths of the side edges 10, 12 of the center section and are pivotally connected thereto along their entire lengths in a manner and with a result to be described. The side panels 20, 22 do not directly support the user when the mat is in use, and in the normal case each of them may be narrow in relation to the width of the center section and may, for example, be six inches wide with good results. The outer side edges of these side panels are indicated at 24, 26.

The head end of the mat is completed by side edge panels 30, 32 each of which is trapezoidal in shape and has a short inner edge 34 which is adjacent, and preferably of the same length as, the head end edge 36 of the adjacent side panel 20 or 22, and a longer head end edge 38 which forms a continuation of the upper end edge 9 of the center section, an inner side edge 40 which adjoins and is pivotally connected, in a suitable manner, to one of the converging side edges 14, 16 of the head end of the central section, and an outer side edge 42, the side edges 40, 42 being outwardly diverging and each forming a continuation of the adjacent one of the outer side edges 24, 26 of the side panels of the bottom of the mat.

In the preferred embodiment of the invention each of the component parts of the mat, these being the central section 2, the side panels 20, 22 at the bottom end of the mat and the side panels 30, 32 at the head end of the mat, is formed of a plurality of parallel rods 50 which extend transversely of the part in which they are located and which are positioned in each part in substantially abutting side-by-side relation and are pivotally connected to each adjacent rod throughout their lengths. In the preferred embodiment now being described this pivotal connection is provided by a sheet 52 formed of flexible material which covers the entire lower surface of the mat and to which all of the rods 50 of the mat are connected by any suitable means such as an adhesive. This sheet not only pivotally connects the rods of each part of the mat but also pivotally connects the bottom end side panels 20,22 and the head end side panels 30, 32 to the central section 2.

Figure 2:
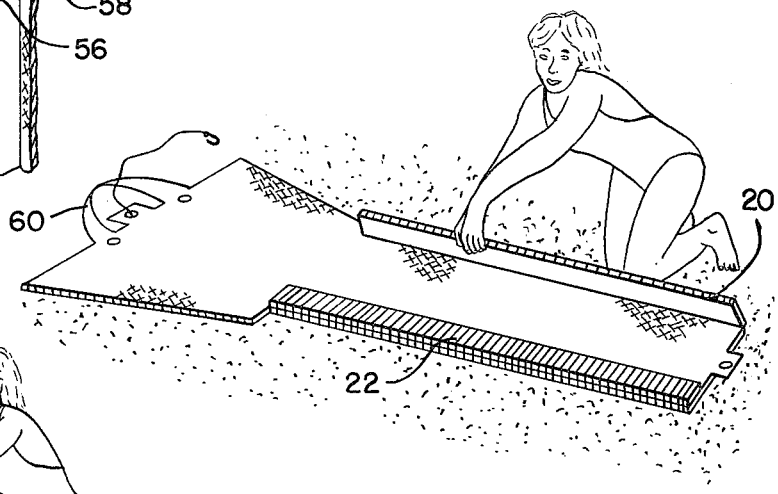
FIGS. 2, 3 and 4 illustrate successive steps in a preferred procedure for setting up the mat for use as a back rest.
Figure 3:
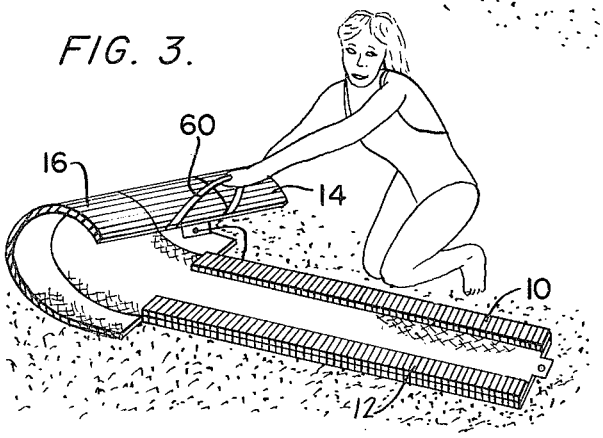
Figure 4:
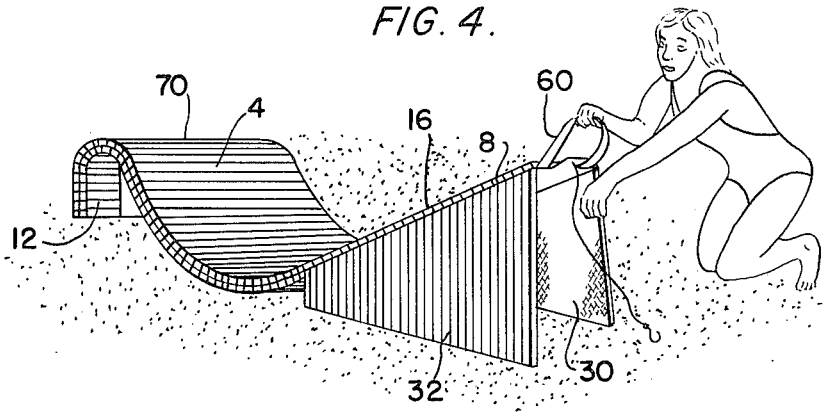

It will be seen that because of the positioning of the connecting sheet 52 on the lower surface of the mat the side edge panels 20, 22 and 30, 32 may be pivoted only to the back of the mat, as shown in FIGS. 2, 3 and 4 and cannot be turned to lie in face-to-face engagement with the upper surface of the mat as such movement would be prevented by engagement of the ends 56, 58 of the rods forming the component parts of the mat.

Figure 5:
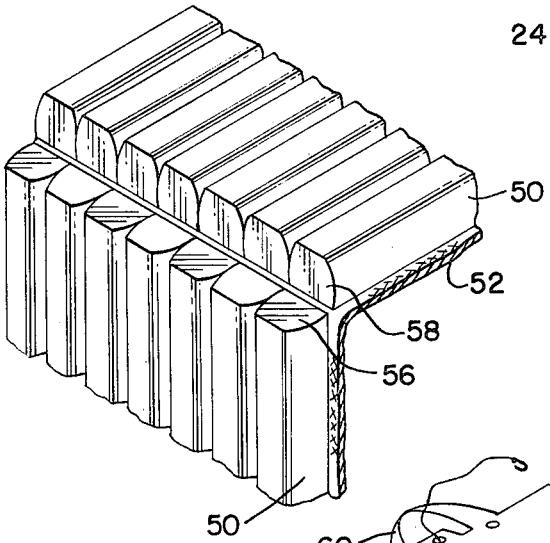
FIG. 5 is a partial perspective view taken on line 5—5 of FIG. 1 showing a preferred means for connecting the parts of the mat, the parts being shown in open position.

A preferred method of adjustment of the parts of the mat for its intended use is illustrated in FIGS. 2, 3 and 4 and is performed by first laying the entire mat out flat and upside down, which means that the upper surface of all component parts are in contact with the ground and the connecting means 52 between the rods and between the component parts is facing upwardly. The first step is illustrated in FIG. 2 and consists in turning both of the side edge panels 20, 22 of the bottom part of the mat about their pivotal connection to the bottom end of the center section 4 into engagement with the back surface of the center section. The head end of the mat is then manually grasped by handle 60 and pulled over the lower end of the mat as illustrated in FIG. 3. When this movement is completed the rods of the center section 4 and the head end side panels 30, 32 are facing upwardly and those of the two bottom end side panels 10, 12 are doubled under the center section with their rods facing downwardly. The upper end side panels 30, 32 may now be turned to vertical or near vertical position, as shown in FIG. 4, in which position they support the head end of the mat in raised position thus providing support to the head or back of the user. The bottom part of the center section may be left flat or raised in a curve for leg or knee support as shown at 70 in FIG. 5 and this raised condition will be maintained by reason of the position of the two side panels 12, 14 in engagement with the rear surface of the center section, in which position the pivotal connections of the rods of the side panels and those of the center section are in engagement and opposition, thereby producing a rigid structure and preventing collapse of the upwardly raised part of the center section.

Figure 6:
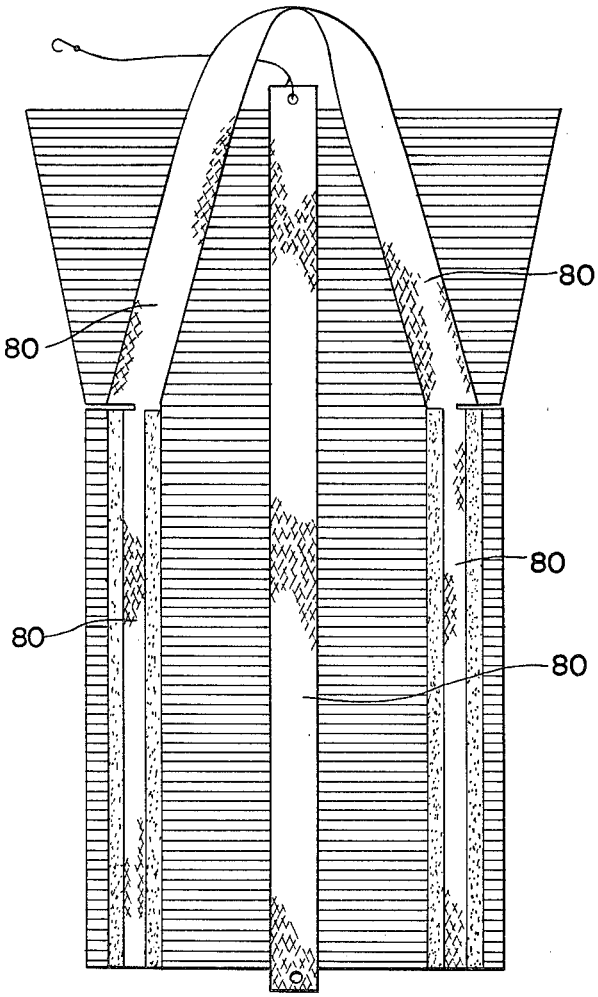
FIG. 6 shows an alternative means for pivotally connecting the side panels to the center section of the mat.
Figure 8:
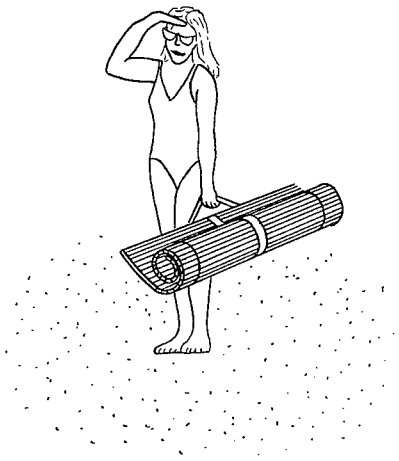
FIG. 8 shows the mat in rolled condition.

An alternative means for providing the pivotal connection between adjacent rods 50 and between adjacent parts of the mat is disclosed in FIG. 6 and comprises the required number of narrow strips 80 formed of flexible material which are preferably adhesively connected to the back surface of the mat along the abutting edges of the two sets of side edge panels and the center section.

Figure 7:
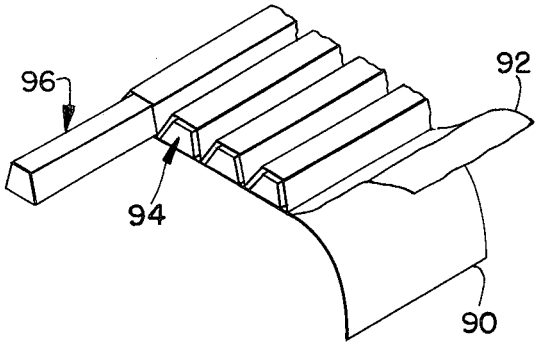
FIG. 7 shows an alternative construction for each part of the mat.

In a further embodiment of the invention, which is disclosed in FIG. 7, each of the component parts of the mat may be formed of two superposed sheets 90, 92 which are so constructed that they provide between them spaced elongated parallel openings 94 within each of which a rod 96 is positioned and held in any suitable manner such as by adhesive.

As used in this specification and claims the word "rod" is to be understood to mean any elongated solid or tubular element which may be formed of any suitable material and may be rigid or flexible.

Although the invention is primarily intended for use as a beach mat, it is understood that any application, or use requiring a flat surface which easily converts to a rigid three-dimensional structure, and which rolls up for carrying and storage, is provided by the structural principles of the invention in using elongated parallel rigid members which are pivotally interconnected transversely, severed along a common line and additionally pivotally connected along the common line to form a resilient flat surface which becomes a rigid three-dimensional structure upon folding along the common line, and which may be rolled up from the flat condition.

It is further understood that the preceding description is given merely by way of illustration and that various modifications may be made thereto without departing from the spirit or scope of the invention as claimed.

I claim:

1. A rest mat for human use which may be disposed in various configurations for supine, seated, backrested and other positions, having an upper surface to receive the body, a lower surface, a head end and a bottom end, and comprising these component parts:

(a) an elongated center section extending from end to end of the mat and having
  i. a bottom end part with parallel side edges, and
  ii. a head end part with side edge which form continuations of the side edges of the bottom end part and converge therefrom to the head end of the mat, (b) side edge panels which extends along the side edges of the bottom end part of the center section and are pivotally connected thereto to be folded behind the upper surface of the mat into engagement with the lower surface thereof, (c) side edge panels which extend along each side edge of the head end part of the center section and are pivotally connected thereto to be folded toward the lower surface of the mat, and
  i. each of the side edge panels at the head end of the mat having outer side edges which diverge toward the head end of the mat.

2. The mat according to claim 1, which is formed of means which permit the mat to be rolled from end to end to form a spiral bundle for carrying.

3. The mat according to claim 1, in which the pivotal connections between the component parts is provided by a sheet of flexible material covering the lower surface of the mat and connected to all parts thereof.

4. The mat according to claim 1, in which the pivotal connection between the component parts of the mat is provided by elongated strips of flexible material connected to the rear surface of the mat and extending along each pivotal connection between component parts of the mat.

5. The mat according to claim 1, in which each component part is formed of parallel flexibly connected rods which extend transversely of the mat and all of which are parallel.

6. The mat according to claim 1, in which each component part comprises two superposed connected sheets of flexible material defining between them spaced elongated parallel openings, and a rod positioned in each opening and held therein.

* * * * *